US006936155B1

(12) United States Patent
Morimitsu et al.

(10) Patent No.: US 6,936,155 B1
(45) Date of Patent: Aug. 30, 2005

(54) METHOD FOR ELECTROPLATING OF TANTALUM

(75) Inventors: Masatsugu Morimitsu, Kitakyushu (JP); Morio Matsunaga, Kitakyushu (JP)

(73) Assignee: Japan Science and Technology Agency, Kawaguchi (JP)

( * ) Notice: Subject to any disclaimer, the term of this patent is extended or adjusted under 35 U.S.C. 154(b) by 131 days.

(21) Appl. No.: 10/239,836

(22) PCT Filed: Nov. 8, 2000

(86) PCT No.: PCT/JP00/07835

§ 371 (c)(1),
(2), (4) Date: May 30, 2003

(87) PCT Pub. No.: WO01/75193

PCT Pub. Date: Oct. 11, 2001

(30) Foreign Application Priority Data

Mar. 30, 2000 (JP) ..... 2000-97861

(51) Int. Cl.[7] ..... C25D 3/66
(52) U.S. Cl. ..... 205/230
(58) Field of Search ..... 205/230, 234

(56) References Cited

U.S. PATENT DOCUMENTS 3,444,058 A * 5/1969 Senderoff et al. ..... 205/358

OTHER PUBLICATIONS

Patent Abstracts of Japan, Publication No. 07-118888, dated May 9, 1995.
Patent Abstracts of Japan, Publication No. 06-057479, dated Mar. 1, 1994.
F. Lantelme et al.; Electrodeposition of Tantalum in NaCl-KCl-$K_2TaF_7$ Melts, J. Electrochem Soc., vol. 139, No. 5, pp. 1249-1255, May 1992.
Morio Matsunaga et al.; Proceedings of the seventh China-Japan Bilateral Conference on Molten Salt Chemistry and Technology, pp. 209-213, Oct. 26-30, 1998, Xian, China.
M. Morimitsu et al.; Electrochemical Behaviors of $TaCl_5$-EMIC Molten Salts, The Electrochemical Society of Japan, p. 233, 1998.
T. Matsuo et al; Electrochemical Reduction of Ta(V) in $TaCl_5$-EMIC Low Temperature Molten Salts (II), The 31st. Symposium on Molten Salt Chemistry, pp. 35-52.

* cited by examiner

*Primary Examiner*—Roy King
*Assistant Examiner*—William T. Leader
(74) *Attorney, Agent, or Firm*—Westerman, Hattori, Daniels & Adrian, LLP

(57) ABSTRACT

The present invention provides a method of electrolytically forming a tantalum film by using a molten-salt electrolytic bath having a low temperature. The electrolytic bath includes a molten salt containing tantalum pentachloride, alkylimidazolium chloride, and an alkali metal or alkali earth metal fluoride such as lithium fluoride.

6 Claims, 1 Drawing Sheet

METHOD FOR ELECTROPLATING OF TANTALUM

TECHNICAL FIELD

The present invention relates to a method of electrolytically forming a tantalum film onto metal, alloy, conductive ceramics, semiconductive ceramics or the like by using a molten-salt electrolytic bath.

BACKGROUND ART

Tantalum is used in a wide range of fields such as electrolytic capacitors, materials of electronic products and materials of chemical devices, by taking advantage of its properties such as a high melting point, a sufficient ductility and malleability and an excellent corrosion resistance. Depending on an intended purpose, tantalum is directly used as a material of such products or devices in some cases, and otherwise used in the form of a tantalum film on a base material, e.g. a tantalum thin-film formed as a barrier film on a copper wiring of a LSI.

Various physical and chemical vapor deposition methods such as a vacuum deposition method and a spattering method have been used for forming the tantalum film. In terms of commonly-used methods of forming a film, it is contemplable to use a plating method instead of the above dry type methods. However, it is practically impossible to form a tantalum film through a plating method using an aqueous solution, and a plating method using a molten-salt bath has been known as the only way to form a tantalum film.

For example, there has been reported a method using a molten-salt bath comprising lithium chloride-potassium chloride molten salt having tantalum pentachloride added thereto to allow a tantalum film to be electrolytically formed at a molten-salt bath temperature of 450° C., and a method using a molten-salt bath comprising potassium chloride-sodium chloride molten salt having $K_2TaF_7$ added thereto to allow a tantalum film to be electrolytically formed at a molten-salt bath temperature of about 700° C. (J. Electrochem. Soc., Vol. 139, No. 5, May 1992, pp. 1249–1255).

Further, Japanese Patent Laid-Open Publication No. 06-057479 discloses a method of plating tantalum onto an object such as iron by using a tantalum plate as an anode and an electrolytic bath which comprises a molten-salt consisting of a fluoride eutectic mixture of LiF—NaF—KF (50-30–20 mol %) and $K_2TaF_7$ additionally dissolved therein and has a temperature of 600 to 900° C., and periodically reversing the direction of a supply current.

However, the above conventional tantalum plating methods are based on a high-temperature molten-salt bath, and there has not developed any molten-salt electrolytic bath capable of providing an electrolytically formed tantalum film at a low electrolytic bath temperature, e.g. room temperature or about 100° C.

DISCLOSURE OF THE INVENTION (Problem to be Solved by the Invention)

For the aforementioned reasons, the dry type methods are predominantly used to form a tantalum film, but undesirably place a limit on the size and/or thickness of the obtained tantalum film. While the plating method is advantageously free from such limitations, any tantalum-film forming method using the conventional molten salts has not been commercially used due to unsatisfactory workability, safety and/or cost resulting from the high-temperature and highly-reactive molten-salt bath.

It is therefore an object of the present invention to provide a method of electrolytically forming a tantalum film by using a low-temperature electrolytic bath, so as to overcome the above disadvantages.

(Means for Solving the Problem)

The inventors have researched electrode reaction of metal ion using various kinds of molten salts. Through the research, it was found that a molten salt was formed at a temperature of 100° C. or less by mixing tantalum pentachloride and 1-ethyl-3-methylimidazolium chloride. This finding has been reported ("Abstracts of technical papers in the autumn meeting 1998 of the Electrochemical Society of Japan", p. 233, 1998; "Proc. of the 7th China-Japan Bilateral Conf. on Molten Salt Chem. and Technol." pp. 209–213, 1998).

Further, the inventors found that a tantalum film could be electrolytically formed even at a low electrolytic bath temperature through the use of a molten salt prepared by adding an alkali metal or alkali earth metal fluoride into the molten salt having the above composition. This knowledge opened the way for realistically achieving a tantalum plating method using a low temperature electrolytic bath, and the present invention has been finally made.

Specifically, the present invention provides a method of electrolytically forming a tantalum film by using an electrolytic bath which comprises a molten salt containing tantalum pentachloride, alkylimidazolium chloride, and an alkali metal fluoride or alkali earth metal fluoride.

In the present invention, the alkylimidazolium chloride may be 1-ethyl-3-methylimidazolium chloride.

Further, the alkali metal fluoride or alkali earth metal fluoride may be lithium fluoride.

The alkylimidazolium chloride used in the method of the present invention may include 1-methyl-3-methylimidazolium chloride, 1-ethyl-3-methylimidazolium chloride, 1-ethyl-3-ethylimidazolium chloride, 1-methyl-3-propylimidazolium chloride, 1-methyl-3-butylimidazolium chloride, and 1-butyl-3-butylimidazolium chloride, but the alkyl group and combination thereof are not limited to the above examples.

The alkali metal fluoride or alkali earth metal fluoride used in the method of the present invention preferably has a relatively strong ionic bonding and a capability to provide a fluoride ion readily in a molten-salt bath. Specifically, the alkali metal fluoride or alkali earth metal fluoride may include lithium fluoride, sodium fluoride, potassium fluoride, beryllium fluoride, magnesium fluoride, and calcium fluoride. In particular, lithium fluoride has a strong ionic bonding and a capability to generate a fluoride ion readily in a molten-salt bath and provide a lithium ion which is a cation having a small ionic radius.

While a detailed mechanism has not been figured out, it can be assumed that a part or all of chloride ions coordinated at tantalum in the molten salt are substituted with fluoride ions, which provides a deteriorated symmetry in the electrical structural of a pentavalent tantalum complex in the molten salt, and the pentavalent tantalum complex having the resultingly increased reduction property is deoxidize and formed in zero-valent tantalum allowing a tantalum film to be electrolytically formed. The cation having a small ion radius such as lithium ion in the molten salt would further deteriorate the electronic symmetry in the structure of the tantalum complex to facilitate deoxidization of the tantalum complex. From the above reasons, lithium fluoride is more desirable than other alkali metal fluorides or alkali earth metal fluorides.

FIG. 1 is a cyclic voltammogram obtained by using a platinum electrode in an electrolytic bath comprising a molten salt which contains tantalum pentachloride, 1-ethyl-3-methylimidazolium chloride and lithium fluoride (with a mixing ratio of 30:60:10 mol % in order of the description), at an electrolytic bath temperature of 100° C.

In FIG. 1, four reduction waves A, B, C and D observed during a potential scan to the cathode direction correspond to reduction of pentavalent tantalum complex, and show that the reduction from the pentavalent tantalum complex to zero-valent tantalum is caused in the molten salt under at least four stages.

By contrast, in a cyclic voltammogram obtained when lithium fluoride is excluded from the above molten salt, only the waves A and B were observed. Thus, it is proved that the reduction for finally forming the zero-valent tantalum or providing an electrolytically formed tantalum film is caused at the stages corresponding to the waves C and D which are caused newly by adding the lithium fluoride.

Preferably, the tantalum pentachloride, alkylimidazolium chloride and alkali metal or alkali earth metal fluoride are mixed at the following ratio. As to two components of the tantalum pentachloride and the alkylimidazolium chloride, the mole ratio of the tantalum pentachloride to the two components is preferable from 30 mol % to 50 mol %, and the mole ratio of the alkylimidazolium chloride to the two components is preferably from 50 mol % to 70 mol %. The mol ratio of the alkali metal or alkali earth metal fluoride to the total mole number of the tantalum pentachloride and the alkylimidazolium chloride is preferably from 2 mol % to 13 mol %.

If the tantalum pentachloride is less than 30 mol % or the alkylimidazolium chloride is greater than 70 mol %, a melting point for forming the molten salt will undesirably go up, and thereby the molten salt will not be formed at a low temperature of 100° C. or less. Similarly, if the tantalum pentachloride is greater than 50 mol % or the alkylimidazolium chloride is less than 50 mol %, the melting point for forming the molten salt will undesirably go up, and thereby the molten salt will not be formed at 100° C. or less.

On the other hand, if the alkali metal or alkali earth metal fluoride is less than 2 mol %, the deoxidizing effect for providing the zero-valent tantalum will not be obtained due to an insufficient ratio of the fluoride, and thereby it will be difficult to electrolytically form a tantalum film. If the alkali metal or alkali earth metal fluoride is greater than 13 mol %, a part of the fluoride cannot be dissolved and left in the molten salt as a solid substance or unprofitable fluoride which does not act as the molten salt.

More preferably, as to two components of the tantalum pentachloride and the alkylimidazolium chloride, the mole ratio of the tantalum pentachloride to the two components is preferable from 33.3 mol % to 45 mol %, and the mol ratio of the alkylimidazolium chloride to the two components is preferably from 66.7 mol % to 55 mol %. The mol ratio of the alkali metal or alkali earth metal fluoride to the total mole number of the tantalum pentachloride and the alkylimidazolium chloride is preferably from 5 mol % to 10 mol %.

A representative example of electrolysis conditions will be described below. A cathode may be made of various materials such as metal, alloy, conductive ceramics or semiconductive ceramics. For example, the material of the cathode may include, but not limited to, an iron material, nickel and copper. A thin-film-shaped metal, alloy or ceramics formed on a different material may also be used as the cathode. An anode may be formed of, but not limited to, a plate-shaped material made of tantalum, tungsten, molybdenum, platinum or the like, or a thin-film-shaped material made of these materials and formed on a different material.

When the anode is made of tantalum, an anodic reaction will be dominated by dissolution of the tantalum. In contrast, when using other material, the anodic reaction will be dominated by generation of chlorine. In this case, it is desirable to use an anode material having a low overvoltage and a high durability for the reaction of generating chlorine.

A current density may be arranged, for example in the range of 0.01 $A/cm^2$ to 1 $A/cm^2$, based on a value used in a conventional electroplating. However, the current density is not limited to the above range, and should be selectively arranged depending on whether the electrolytic bath is used in a static or flowing state, or other factors such as a molten-salt bath temperature or a current waveform, because an adequate value of the current density is varied in response to such factors.

In addition to a current control method, a potential control method may be used to supply current during plating. In the current control method, various kinds of current waveforms such as a constant current and a pulse current may be used, or a reverse current may be periodically applied. Similarly, in the potential control method, various kinds of voltage waveforms such as a constant voltage and a pulse voltage may be used, or a reverse voltage may be periodically applied.

The molten-salt bath temperature is preferably 150° C. or less, more preferably 100° C. or less. The temperature of greater than 150° C. causes decomposition of the alkylimidazolium chloride, resulting in undesirably accelerated deterioration of the molten salt. According to the plating method of the present invention under the above electrolysis conditions, a tantalum film having a thickness of up to about 100 $\mu$m can be electrolytically formed.

BEST MODE FOR CARRYING OUT THE INVENTION (Examples 1 to 4), (Comparative Examples 1 to 2)

Examples of the present invention (inventive examples) will now be described in detail in contrast to comparative examples. In a glove box under inert gas atmosphere, tantalum pentachloride ($TaCl_6$), 1-ethyl-3-methylimidazolium chloride (EMIC) and lithium fluoride (LiF) were scaled for each of the inventive examples according to respective given amounts as shown in Table 1. A set of the materials for each of the inventive examples was put in a glass tube, and the respective glass tubes were depressurized and sealed. Then, each of the glass tubes was heated up to 100° C. to form a molten salt.

TABLE 1

| | Composition of Molten Salt | | | Presence of |
|---|---|---|---|---|
| | Tantalum pentachloride | 1-ethyl-3-methylimidazolium chloride | lithium fluoride | formed tantalum film (after 4 hours from current supply) |
| Inventive Example 1 | 30 mol % | 60 mol % | 10 mol % | Formed |
| Inventive Example 2 | 45 mol % | 45 mol % | 10 mol % | Formed |
| Inventive Example 3 | 33 mol % | 65 mol % | 2 mol % | Formed |
| Inventive Example 4 | 49 mol % | 49 mol % | 2 mol % | Formed |
| Comparative Example 1 | 33.3 mol % | 66.7 mol% | W/O | None |
| Comparative Example 2 | 50 mol % | 50 mol % | W/O | None |

Figure 1:
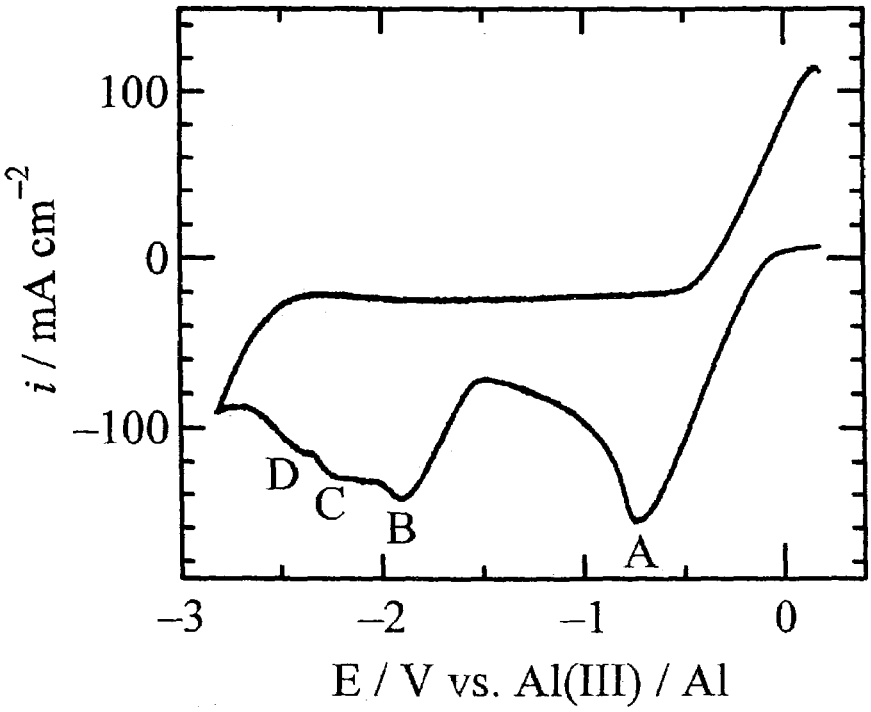
FIG. 1 is a cyclic voltammogram obtained by using an electrolytic bath comprising a molten salt containing tantalum pentachloride and 1-ethyl-3-methylimidazolium chloride which have a mole ratio of 1:2, and lithium fluoride added thereto.
Figure 2:
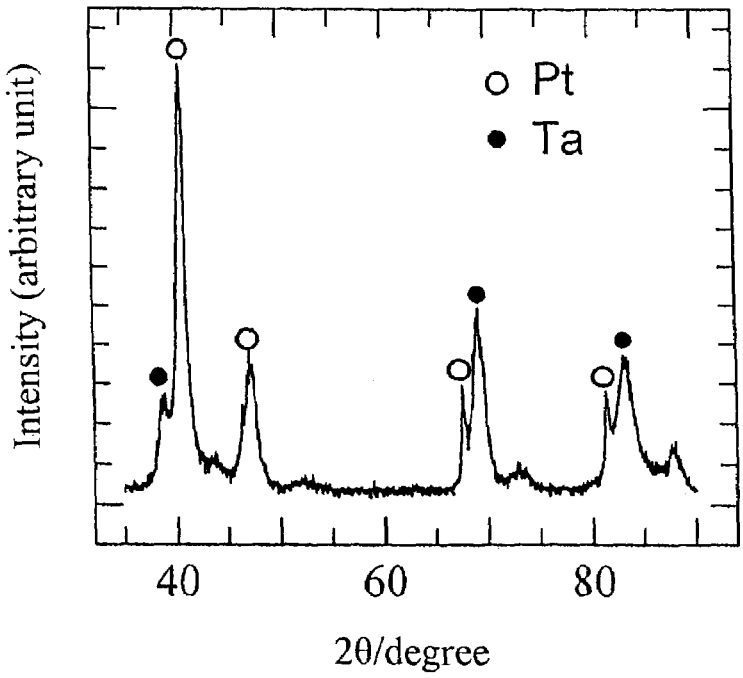
FIG. 2 is a graph showing an X-ray diffraction pattern of a tantalum film electrolytic formed through the method of the present invention.

In the glove box, each of the molten salts was transferred into a glass cell having a pair of platinum electrodes, and the respective glass cells were depressurized and sealed. Each of the glass cells was placed in an electric furnace, and an electrolytic process was performed by supplying a constant current from a power supply at a molten salt temperature of 100° C. After continuing the electrolytic process by supplying the current for four hours, each surface of the platinum electrodes used as a cathode was rinsed out, and then analyzed by an X-ray diffractometer to check whether a tantalum film was electrolytically formed. FIG. 2 is a graph showing an X-ray diffraction pattern of one of the formed tantalum film. FIG. 2 shows diffraction peaks of the platinum used as the cathode and diffraction peaks of tantalum. This proves that a tantalum film is electrolytically formed on the cathode.

On the other hand, molten salts each having a composition as shown in Table 1 or composed of a mixture of tantalum pentachloride and 1-ethyl-3-methylimidazolium chloride were prepared as comparative examples, and the same operations as those in the inventive examples were performed. The presence of an electrolytically formed tantalum film in each of the inventive and comparative examples is shown in Table 1.

As can be seen from the results of Table 1, the plating method of the present invention allows a tantalum film to be electrolytically formed even at a low molten-salt bath temperature of 100° C. at which the conventional plating method has not been able to form a tantalum film. Further, it was verified that the inventive examples 1 and 3 each having a small mole ratio of tantalum pentachloride could electrolytically form a tantalum film through an electrolytic process at room temperature.

INDUSTRIAL APPLICABILITY

According to the present invention, a tantalum film can be electrolytically formed in a molten-salt electrolytic bath even at a low bath temperature of 100° C. or less. Thus, the present invention can provide a tantalum-film forming method significantly advantageous to workability, safety and/or cost.

What is claimed is:

1. A method for electrolytically forming a tantalum film, comprising the steps of:

providing molten-salt a electrolytic bath containing tantalum pentachloride, alkylimidazolium chloride, and an alkali metal or alkali earth metal fluoride;

providing an anode and a cathode in said electrolytic bath; and supplying electric current between said anode and said cathode.

2. A method as defined in claim 1, wherein the alkylimidazolium chloride is 1-ethyl-3-methylimidazolium chloride.

3. A method as defined in claim 1, wherein the alkali metal or alkali earth metal fluoride is lithium fluoride.

4. A molten-salt electrolytic bath for forming a tantalum film, comprising:

tantalum pentachloride;

alkylimidazolium chloride; and an alkali metal or alkali earth metal fluoride.

5. The molten-salt electrolytic bath as defined in claim 4, wherein the alkylimidazolium chloride is 1-ethyl-3-methylimidazolium chloride.

6. The molten-salt electrolytic bath as defined in claim 4, wherein the alkali metal or alkali earth metal fluoride is lithium fluoride.

* * * * *